US006366184B1

(12) United States Patent
Ohtonen

(10) Patent No.: US 6,366,184 B1
(45) Date of Patent: Apr. 2, 2002

(54) RESONATOR FILTER

(75) Inventor: Jorma Ohtonen, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/517,925

(22) Filed: Mar. 3, 2000

(30) Foreign Application Priority Data

Mar. 3, 1999 (FI) ..... 990462

(51) Int. Cl.[7] ..... H01P 1/20; H01P 7/00; H01P 7/04; H01P 7/06

(52) U.S. Cl. ..... 333/202; 333/203; 333/206; 333/219; 333/222; 333/227

(58) Field of Search ..... 333/202, 203, 333/204, 206, 222, 227, 219

(56) References Cited

U.S. PATENT DOCUMENTS

| | | | |
|---|---|---|---|
| 2,161,419 A | 6/1939 | Kipperman et al. | |
| 3,064,347 A | 11/1962 | Hilton | |
| 3,571,768 A | 3/1971 | Gundry | |
| 3,668,757 A | 6/1972 | Rieder | |
| 4,034,319 A | 7/1977 | Olsson | |
| 4,112,398 A | 9/1978 | Burnett et al. | |
| 4,278,957 A | 7/1981 | Starai et al. | |
| 4,280,113 A | 7/1981 | Sekiguchi | |
| 4,292,610 A | 9/1981 | Makimoto et al. | |
| 4,307,357 A | 12/1981 | Alm | |
| 4,342,969 A | 8/1982 | Myers et al. | 333/33 |
| 4,398,164 A | 8/1983 | Nishikawa et al. | |
| 4,706,051 A | 11/1987 | Dieleman et al. | |

(List continued on next page.)

FOREIGN PATENT DOCUMENTS

| | | |
|---|---|---|
| EP | 0 526 643 A1 | 1/1992 |
| FR | 88 13535 | 10/1988 |
| GB | 2 067 848 A | 1/1980 |
| JP | 59223002 | 12/1984 |
| WO | WO 93/01625 | 1/1993 |
| WO | 97/18598 | 5/1997 |

OTHER PUBLICATIONS

European Search Report dated May 25, 2000.

International Search Report dated Mar. 17, 1997.

Aluminum impacts design manual and application guide, published by Forgings and Impacts Division of The Aluminum Association, pp. 1–37, Dec. 1988.

International Search Report for EP 97 66 0077 dated Oct. 27, 1998.

*Primary Examiner*—Robert Pascal
*Assistant Examiner*—Patricia T. Nguyen
(74) *Attorney, Agent, or Firm*—Darby & Darby

(57) ABSTRACT

The invention comprises a filter consisting of resonators (330, 320, . . . ) with a conducting housing, particularly to be used in networks operating on microwave frequencies. The couplings between the resonators are realised outside the conducting filter housing with the aid of a printed board (310) over a wall (306) of the housing. For a particular coupling a conductor strip (311) extending from one resonator to another is formed on the printed board, and openings (335, . . . ) are made in the resonator walls at the ends of the strips. In order to strengthen the coupling a coupling element (343) extending into the resonator cavity can be fastened as an extension of the strip. The filter connectors (301, . . . ) are also fastened to the printed board. The open filter housing (305) and the inner conductors (331, 341, . . . ) or the resonators can be made as a homogenous body. The manufacturing costs and the tuning costs of a filter according to the invention are relatively low. The losses of the filter are relatively low, the filter is easy to modify, and on the printed board it is possible to realise also functions which are external to the filter.

10 Claims, 4 Drawing Sheets

Figure 3:
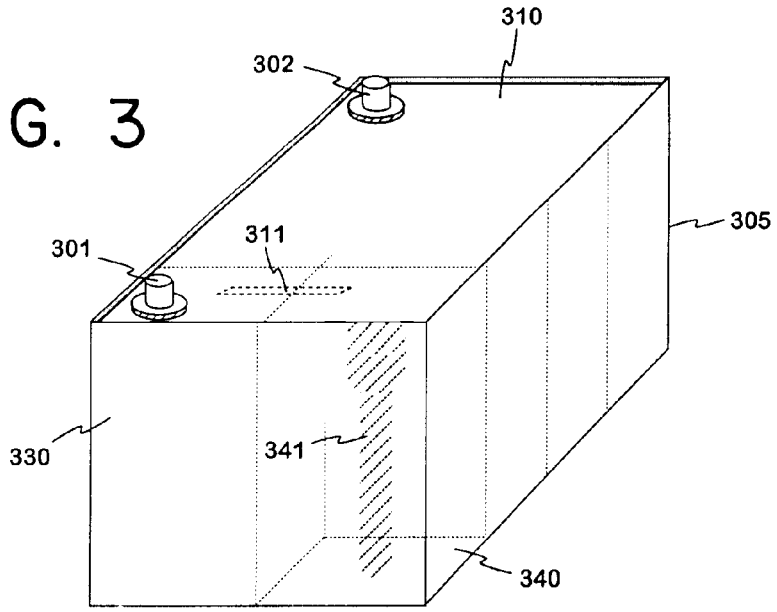

U.S. PATENT DOCUMENTS 4,757,288 A 7/1988 West ..... 333/206
4,991,228 A * 2/1991 Ohta et al. ..... 455/323
5,153,542 A * 10/1992 Tai et al. ..... 333/204
5,329,687 A 7/1994 Scott et al.
5,434,579 A * 7/1995 Kagoshima et al. . 343/700 MS
5,502,715 A 3/1996 Penny
5,572,175 A * 11/1996 Tada et al. ..... 333/206
5,949,309 A * 9/1999 Correa ..... 333/202
5,990,763 A 11/1999 Sipila
6,078,231 A * 6/2000 Pelkonen ..... 333/203

* cited by examiner

FIG. 1
PRIOR ART
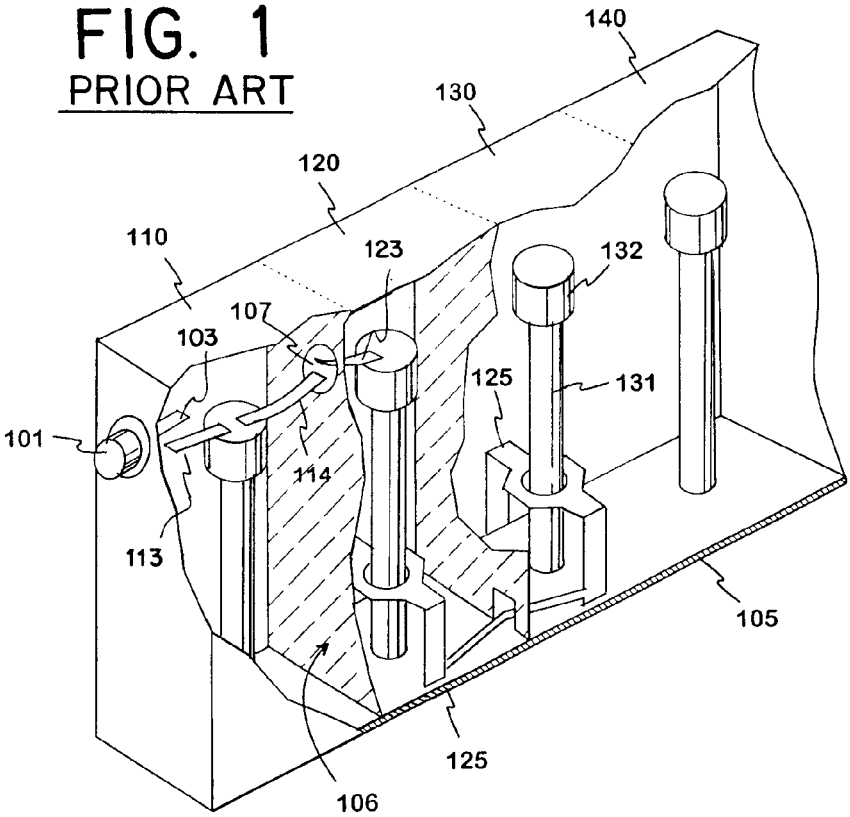
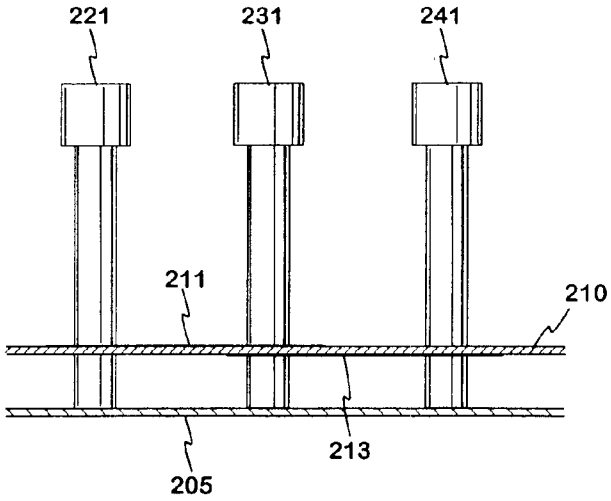
FIG. 2a
PRIOR ART
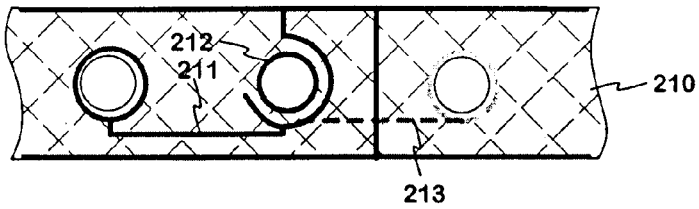
FIG. 2b

RESONATOR FILTER

The object of the invention is a filter structure formed by resonators comprising a conductive housing, so that the filter structure is suitable to be used generally on microwave frequencies, for instance as a duplex filter in base stations of mobile communication networks, in satellite links and in WLL (wireless local loop) networks.

When the requirements placed on the filter are relatively stringent, for instance regarding the transition band between the pass band and the stop band and regarding the attenuation on the stop band, then the order of the filter will become relatively high. In the case of a resonator filter this means that the structure consists of a number of single resonators and couplings between them. The structure is relatively complicated and its manufacture causes substantial costs. Thus the essential question is how low manufacturing costs we can obtain with a filter which meets the requirements.

A great number of filter structures based on resonators are previously known. Usually the resonators are arranged in a row, so that outwardly they form a uniform metal housing. The most common resonator type is the coaxial quarter-wave resonator. The coupling between the resonators is arranged either capacitively or inductively with the aid of auxiliary components. In its details the coupling mechanism may vary quite considerably. FIG. 1 shows an example of such a prior art filter, partly opened and disassembled. It contains in a row four coaxial resonators 110, 120, 130 and 140. Each resonator comprises an inner conductor, such as 131, and an extension part for it, like 132. The extension part increases the capacitance at the upper end of the structure, in other words at the open end, whereby the resonator can be made shorter in the vertical direction. Each resonator further comprises an outer conductor which is formed by the resonator partitions, by side wall parts of the whole resonator housing, and for the outermost resonators by the gable walls. The structure operates as a quarter-wave resonator because each inner conductor is at its lower end connected to the filter's conducting bottom plate 105 acting as a part of the signal ground. Thus the line formed by the inner and outer conductors is short-circuited at its lower end. The structure is covered by a conductive lid, so that the filter housing is closed. It must be observed that a resonator in this description and in the claims means logically the whole resonating structure, not only the inner conductor. FIG. 1 shows as an example one capacitive coupling and one inductive coupling between the resonators. The capacitive coupling is between the resonators 110 and 120 at their open ends where the electrical field is relatively strong. The partition 106 between the resonators 110 and 120 has an opening 107 for the capacitive coupling. At the ends of the inner conductors of said resonators there are fastened blades 114, 123 which are directed towards this opening, thus increasing the coupling capacitance between the resonators. Via the connector 101 the filter is fed also capacitively with the aid of the blades 103, 113. The inductive coupling is between the resonators 120 and 130, close to their shorted ends where the magnetic field is relatively strong. For the inductive coupling a body 125 of conducting board is shaped so that it extends close to the inner conductor of said resonators and that it is grounded in suitable places. The body 125 generates a mutual inductance between the resonators. The feed of the resonators could also be realised inductively. A disadvantage of the described structure and of corresponding structures is that it is cumbersome to tune the filter, which entails costs. Also the actual manufacture before the tuning generates relatively high costs.

FIGS. 2*a* and 2*b* shows another example of a prior art structure (Fl 970525). The basic structure of the filter is similar to that of FIG. 1. In the FIG. 2*a* there is seen of the structure the bottom plate 205 and three central conductors 221, 231, 341. Close to the short-circuited ends of the resonators there is a dielectric board 210 parallel with the bottom plate 205. The inner conductors extend through the dielectric board via the openings seen in it. The coupling between the resonators is now provided by conductor strips formed on the dielectric board 210. FIG. 2*a* shows two such conductor strips 211 and 212. FIG. 2*b* is a top view of the board 210. In this example the conductor strip 211 forms a loop around the central conductor 221, and an incomplete loop around the central conductor 231. Nearest to the central conductor 231 there is a separate conductor loop 212, which shows a mutual inductance with the conductor strip 211. Alternatively, the dielectric board can be also at the bottom of the structure, so that its outer coating replaces the bottom plate 205. Such structures are advantageous to manufacture. However, a disadvantage is the dielectric board having an effect which increase losses and reduces the compactness of the structure.

The objective of the invention is to present a new way to realise a resonator filter which reduces the disadvantages. The filter structure according to the invention is characterised in that what is presented in the independent claim. Some advantageous embodiments of the invention are presented in the dependent claims.

The basic idea of the invention is as follows: in the manufacturing phase of the filter housing that side of the housing left open is closed with a conducting lid. For the couplings between the resonators a dielectric board is placed outside the conducting filter housing, over some wall and at a suitable distance from it. The couplings are realised with the aid of conductor areas made on the dielectric board and openings made at places corresponding to them in the filter housing. The coupling energy is conveyed through the opening from the resonator to the field of one transmission line on the dielectric board, and from there through another opening to another resonator. In order to make a stronger coupling it is possible to fasten to the conductor area on the dielectric board a coupling element, for instance a thread-like or plate-like conductor which extends through an opening into the housing close to the inner conductor of the resonator. Further it is possible to make openings in the resonator partitions in order to obtain a desired coupling. Also the transferring of signals to the filter and from the filter can be realised utilising said dielectric board as a support structure. The main part of the filter housing and the resonator's inner conductors are manufactured as an integral part using extrusion, casting, tooling or some joining technique.

An advantage of the invention is that the manufacturing costs of the filter are relatively low, because the number of separately mounted components is relatively low. A further advantage of the invention is that the tuning costs of the filter are relatively low, because the printed board couplings are fixed, whereby only relatively simple fine tuning is required. A further advantage of the invention is that the filter has relatively stable characteristics due to the uniform resonator structure. A further advantage of the invention is that the dielectric board used for the couplings does not introduce any substantial losses, because it is outside the filter housing. Due to the same reason it can be made of a cheaper material than in the prior art solutions where the printed board is within the resonator structure. Furthermore, an advantage of the invention is that it enables advantageous methods for the temperature compensation of the filter. The methods are based on the choice of the printed board laminate and on the addition of appropriate conductor areas and/or elements to the printed board. A further advantage of the invention is that it is relatively simple to modify the filter. A further advantage of the invention is that on the filter's printed board it is possible to integrate amplifiers, directional couplers, dividers, adders and antennas or parts of antenna structure which are closely related to the filter.

Figure 5:
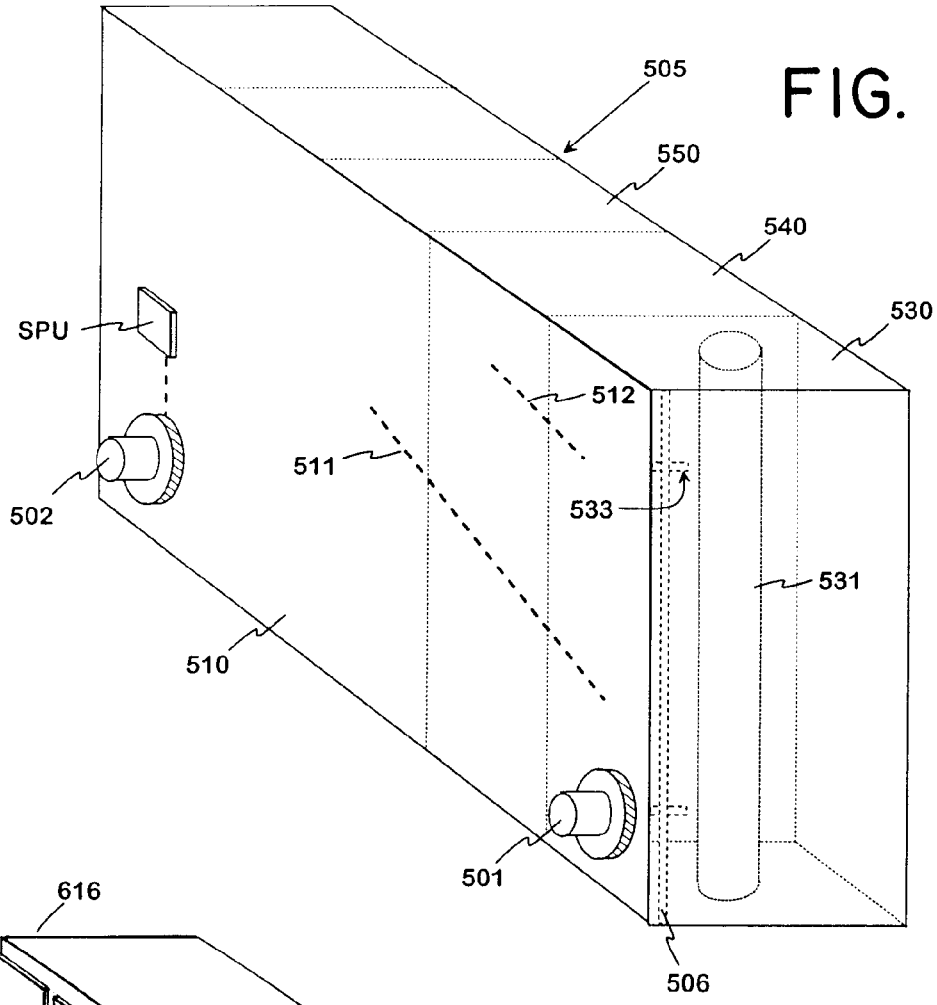
Figure 6:
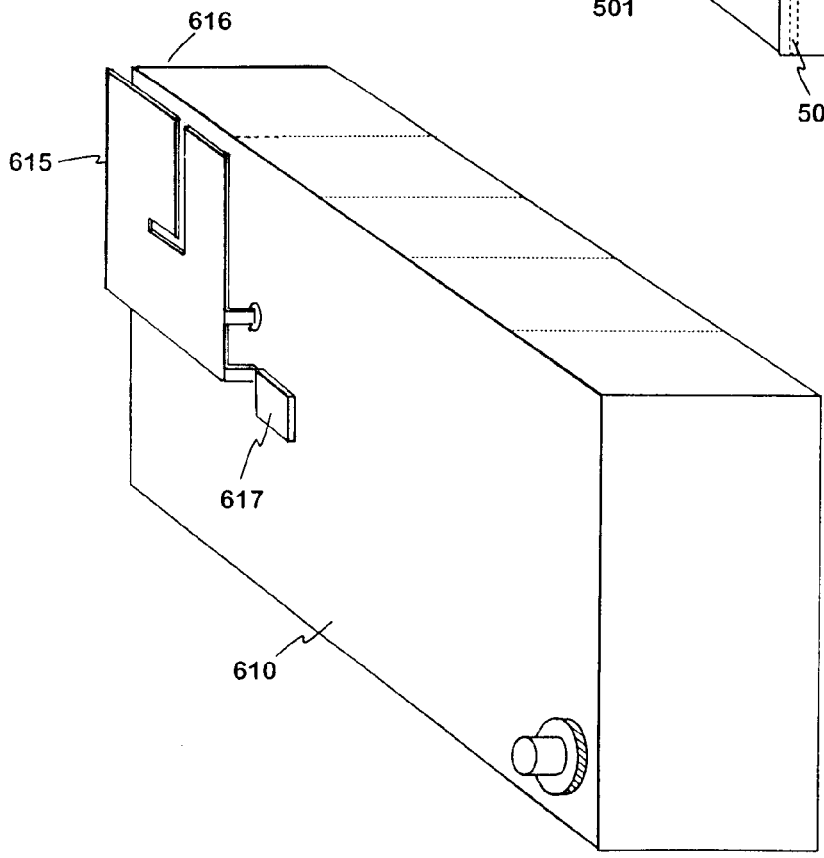
Figure 7:
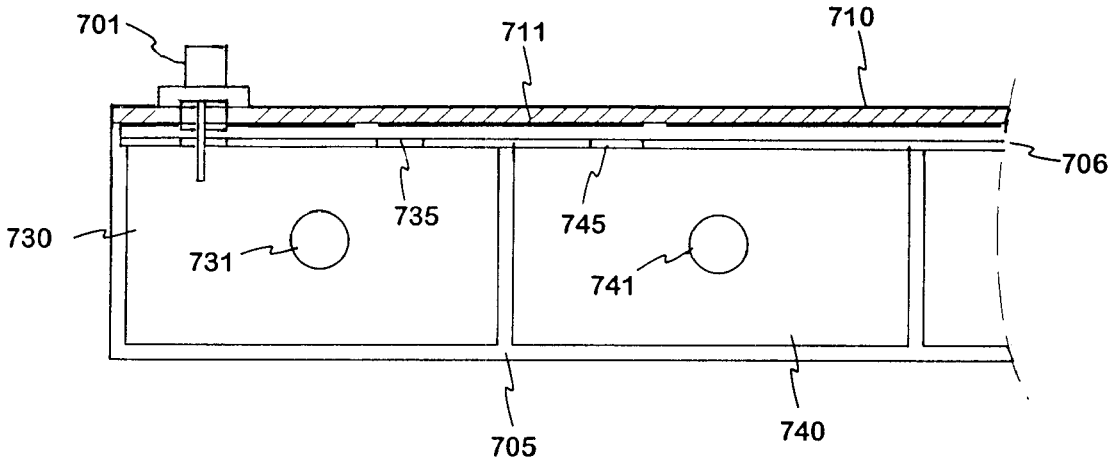

Below the invention is described in detail. In the description reference is made to the enclosed drawings, in which FIG. 1 shows an example of a prior art resonator filter, FIGS. 2*a* and 2*b* show another example of a prior art resonator filter, FIG. 3 shows an example of a filter according to the invention, FIG. 4*a* shows the structure of FIG. 3 in a cross section, FIG. 4*b* shows the printed board of the structure in FIG. 3, FIG. 5 shows another example of a filter according to the invention, FIG. 6 shows a structure according to the invention which comprises an antenna, and FIG. 7 shows a cross section of the structure according to FIG. 5.

The FIGS. 1, 2*a* and 2*b* were described already in connection with the description of prior art.

FIG. 3 is an example of a filter according to the invention as seen from the outside. It comprises eight coaxial resonators, the resonators 330, 340 and six other arranged in two rows. The resonators as such represent prior art. The figure shows the inner conductor 341 of the resonator 340, whereby the lower end of the inner conductor is connected to the bottom plate of the open housing 305, and its upper end is galvanically unconnected. The structure comprises a printed board 310 according to the invention over the conducting lid, which is a part of the filter housing. The filter couplings between the resonators are realised capacitively via the conductor strips on the lower surface of the printed board 310. FIG. 3 shows in broken lines one such conductor strip 311 between the resonators 330 and 340. The upper surface of the printed board 310 is a conductor plane in order to protect the filter coupling circuits. An input connector 301 and an output connector 302 of the filter are also fastened to the printed board 310.

Figure 4A:
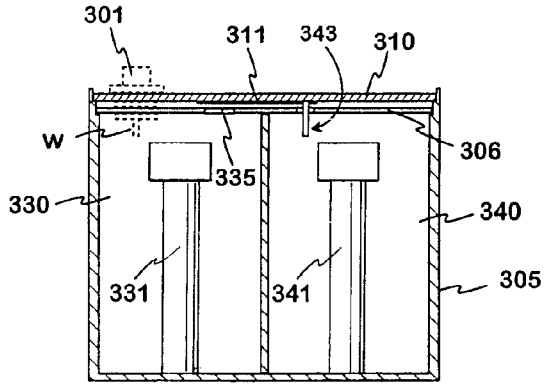
Figure 4B:
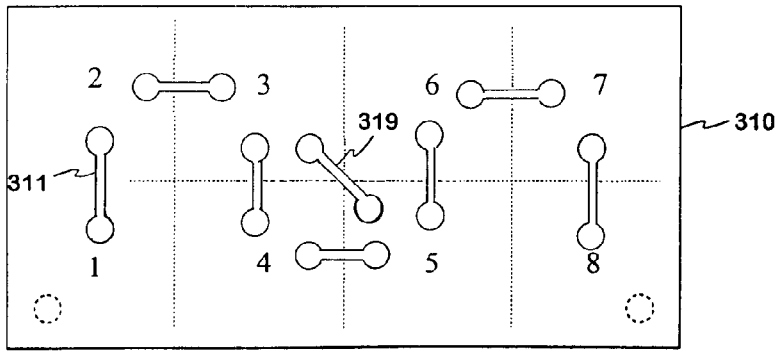

FIG. 4*a* shows the structure of FIG. 3 in a cross section in the direction of the end plane of the filter, at the conductor strip 311. Compared to FIG. 3 the FIG. 4*a* further shows a vertical coupling wire 343 extending into the resonator 340, and a conductor plate 306 below the printed board 310. The plate 306 closes the filter housing. It forms the lid of the resonator cavities. Is has openings at the ends of the conductor strips used for the couplings. The lid of the resonator 330 has one such opening 335. The coupling wire 343 is fastened to the conductor strip 311 so that the junction is electrically conductive. Between the strip and the inner conductor 311 there is a certain small capacitance. Correspondingly there is a certain small capacitance between the inner conductor 331 of the resonator 330 and the conductor strip 311. Regarding the circuit connections these capacitances are connected in series via the conductor strip 311, so that they form the coupling capacitance between the resonators 330 and 340. The magnitude of the coupling capacitance is arranged to be suitable by choosing the locations and sizes of the openings in the lid 306 and the length of the coupling wire 343. FIG. 4*a* shows also with broken lines the input connector 301 of the filter, and the feed wire w. The feed wire w can be a part of the connector 301, or preferably directly the end of the inner conductor of the coaxial feed conductor.

In FIG. 4*a* the conductor plate 306 is mounted in a recess in the vertical walls of the open housing 305, and the printed board 310 is mounted in a slightly larger recess in the vertical walls of the housing 305, whereby the latter recess is above the mounting place of the conductor plate 306. In this respect the structure can be realised in different ways. For instance, the conductor plate 306 can be bent at its opposite edges, so that there are formed groove guides into which the printed board 310 is mounted. The filter housing can also be manufactured so that its vertical walls and the conductor plate 306 are an integral homogenous body, to the lower end of which is fastened the bottom plate with its central conductors. The filter structure also comprises tuning means, such as prior art screws in the cover plate 306. Such details are not drawn visible in the FIGS. 3 and 4*a*.

FIG. 4*b* shows the printed board 310 seen from below. The numbers 1 to 8 represent the areas corresponding to eight resonators. Number 1 represents the resonator 330, and the number 2 represents the resonator 340. Between the areas 1 and 2 there is a conductor strip 311 with expanded ends. The coupling wire 343 is soldered to the expanded area which is the upper area in the figure. The printed board 310 includes other conductor strips similar to the conductor strip 311, so that the resonators are connected in series in an order corresponding to the numbering 1 to 8. In addition to the conductor strips required by the series connection this example includes a conductor strip 319 between the areas 3 and 5. This strip provides the capacitive coupling between said resonators corresponding to said areas. A circuitry like this provides the filter's transfer function with a zero. The zero can be arranged so that the corresponding attenuation peak is located just next to the pass-band, whereby the transition band will be relatively narrow. Naturally the location and the form of the conductor strips can be chosen freely in order to obtain the desired frequency response.

FIG. 5 presents another example of a structure according to the invention. Here the filter comprises five coaxial resonators arranged in a row. In this example the resonators are of the half-wave type which can provide better electrical characteristics than the quarter-wave resonators. The figure shows the inner conductor 531 of the front resonator 530, whereby the lower end of the inner conductor is connected to the lower wall of the open housing 505, and the upper end is connected to the upper wall of the open housing 505. The structure contains a printed board 510 according to the invention over the conducting side wall 506 closing the filter housing. The term "over" in this description and in the claims means that said board is substantially parallel with said side of the filter housing and of the same size as the side and relatively close to said side. The couplings between the resonators are effected electromagnetically via conductor strips on the inner surface of the printed board 510. FIG. 5 shows by broken lines such a conductor strip 511 between the resonators 530 and 550, and a conductor strip 512 between the resonators 530 and 540. As an extension of the strip 512 there is a coupling element 533 in the resonator 530. The coupling circuit comprising the strip 511 transfers energy from the resonator 530 to the resonator 550, and the coupling circuit comprising the strip 512 transfers energy from the resonator 530 to the resonator 540. Other coupling circuits between the resonators are not drawn in the figure. The response of the filter can be modified by choosing suitable forms and locations for the coupling elements and the strips. An input connector 501 and an output connector 502 are also fastened to the printed board 510. Instead of a connector a signal can also be supplied from the filter via a printed board strip or via a separate coupling element. Further in the example of FIG. 5 the printed board 510 has a signal processing unit SPU which is external of the filter and is coupled to the last resonator and to the connector 502. SPU may comprise e.g. amplifier, directional coupler, divider, adder and/or filter, too.

FIG. 6 shows a similar filter as that of FIG. 5. Now an antenna is added to the structure. In this example the antenna is of the PIFA type (planar inverted F antenna). It consists of a radiating element 615 raised above the printed board 610, and as the ground plane for it a part of the conducting outer surface of the printed board 610. An antenna feeding circuit 617 is also drawn in the figure. The planar antenna can be constructed also so that the radiating element is a conductor area on the outer surface of the printed board, and the ground plane is a conductor area on the inner surface of the printed board.

FIG. 7 shows a structure corresponding to FIG. 5, as a cross-section of two resonators 730, 740. In the figure there is an open filter housing 705, in a recess of it a side wall 706 which closes the housing, central conductors 731 and 741 of the resonators, a printed board 710 adjacent the side wall 706, and a connector 701 fastened to the printed board. The outer surface of the printed board is entirely conducting. The side wall 706 has an opening 735 at the location of the resonator 730, and an opening 745 at the location of the resonator 740. On the inner surface of the printed board 710 there is conductor strip 711 which also overlaps the openings 735 and 745. The coupling between the resonators is in this case effected via the openings 735 and 745 without coupling elements.

Some solutions according to the invention were described above. The invention is not limited just to these. For instance, a printed board according to the invention can be on any side of the filter housing, irrespective of the resonator type. If the resonators are in two layers the printed board can be located on two sides of the housing. The resonators of the filter can also be for instance cavity resonators. The inventive idea can be applied in numerous ways within the scope put forward in the independent claim.

What is claimed is:

1. A resonator filter comprising:

at every side electrically conductive housing containing at least two air-insulated resonators and a dielectric board outside said conductive housing for couplings between said resonators.

2. The resonator filter according to claim 1, wherein the resonators are coaxial quarter-wave resonators and said dielectric board is over that side of filter housing which is at the open ends of the resonators.

3. The resonator filter according to claim 1, wherein said resonators are coaxial half-wave resonators and said dielectric board is over that side of the filter housing which is parallel with the plane determined by the central conductors of the resonators.

4. The resonator filter according to claim 1, wherein said resonators are arranged in two layers, and said dielectric board is located on two sides of the filter housing.

5. The resonator filter according to claim 1 comprising a first resonator and a second resonator, wherein the arrangement for said couplings comprises by the first resonator an opening in the wall of the filter housing below the dielectric board, by the second resonator a second opening in the wall of the filter using below the dielectric board, on said dielectric board a conductor strip extending against said openings.

6. The resonator filter according to claim 5 wherein the arrangement of said couplings further comprises at least one coupling element fastened to said conductor strip and ending through said opening into the resonator cavity.

7. The resonator filter according to claim 1, wherein a body is fastened to said dielectric board for connecting a signal line to the filter.

8. The resonator filter according to claim 1, wherein on said dielectric board there is signal processing circuit external of the filter.

9. The resonator filter according to claim 1, wherein said dielectric board forms an integral body with an antenna structure.

10. The resonator filter according to claim 2, wherein the central conductors of resonators and said filter housing, except the wall on the side of the open ends of the resonators, are a homogeneous integral body.

* * * * *